US007146651B1

(12) United States Patent
Lapin

(10) Patent No.: US 7,146,651 B1
(45) Date of Patent: Dec. 12, 2006

(54) MAGNETIC WORK APPAREL

(76) Inventor: Steven B. Lapin, 23679 Calabasas Rd. #213, Calabasas, CA (US) 91302

( * ) Notice: Subject to any disclaimer, the term of this patent is extended or adjusted under 35 U.S.C. 154(b) by 0 days.

(21) Appl. No.: 10/651,448

(22) Filed: Aug. 28, 2003

Related U.S. Application Data

(60) Provisional application No. 60/406,795, filed on Aug. 28, 2002.

(51) Int. Cl.
*A41F 3/02* (2006.01)

(52) U.S. Cl. ..... 2/338

(58) Field of Classification Search ..... 2/338, 2/467, 69, 44, 311–322, 159, 326, 336, 171; 128/95.1, 96.1, 99.1–102, 875, 876; 24/303
See application file for complete search history.

(56) References Cited

U.S. PATENT DOCUMENTS 3,596,134 A * 7/1971 Burke ..... 361/220
3,636,568 A 1/1972 Stuner
3,886,508 A * 5/1975 Lavrard ..... 335/285
4,325,504 A 4/1982 Amani
5,593,073 A 1/1997 Finnegan
6,052,828 A * 4/2000 Widdemer ..... 2/161.2
6,163,889 A * 12/2000 Tate ..... 2/209.13
6,401,253 B1 6/2002 Brunson
6,546,599 B1 * 4/2003 Pelt et al. ..... 24/3.1
6,643,845 B1 * 11/2003 O'Dea et al. ..... 2/161.6
2002/0148031 A1 10/2002 O'Dea et al.

* cited by examiner

*Primary Examiner*—Tejash Patel
(74) *Attorney, Agent, or Firm*—Thomas F. Lebens; Sinsheimer, Juhnke, Lebens & McIvor

(57) ABSTRACT

Magnetic work apparel for retaining various fasteners or tools such as nails, screws, nuts, bolts and drill bits includes a hollow glove member having a backhand portion, a palm portion, a wrist portion defining an opening for receiving a user's hand and a plurality of finger portions. Integral with the backhand portion is a magnet to which ferromagnetic items may be secured to keep such items in a readily accessible location. The invention also includes several magnetic accessory items such as a wristband, a belt and a belt clip. The belt includes snaps or similar fasteners thereon for securing the other items thereto.

4 Claims, 1 Drawing Sheet

MAGNETIC WORK APPAREL

CROSS REFERENCE TO RELATED APPLICATIONS

This application is entitled to the benefit of provisional application No. 60/406,795 filed on Aug. 28, 2002.

BACKGROUND OF THE INVENTION

The present invention relates to worker's apparel having an integral magnet for conveniently retaining small tools or fasteners within reach.

DESCRIPTION OF THE PRIOR ART

Workers often use numerous fasteners or other tools such as nuts, bolts, drill bits, screws and nails when performing certain tasks. Because such items are small and lightweight, they are easily misplaced or positioned in an inaccessible location relative to the work site. Various tool belts and nail bags have been previously designed in an attempt to address this problem; however, such devices are bulky and interfere with the worker's ability to maneuver within confined spaces. The present invention solves the above enumerated problems by providing various work apparel each having a magnet integral therewith to which certain fasteners or tools may be secured. Accordingly, the fastener or tool is always readily available to a worker.

Numerous work gloves and wrist bands, some of which contain integral magnets, exist in the prior art. For example, U.S. published patent application no. 2002/0148031 filed on behalf of O'Dea et al. discloses a magnetic work glove having a pocket on the exterior surface for receiving a magnet allowing a user to secure work related components to the backhand portion of the glove.

U.S. Pat. No. 6,401,253 issued to Brunson discloses a worker's glove having a cylindrical magnetic container secured to the backhand portion thereof.

U.S. Pat. No. 5,593,073 issued to Finnegan discloses a worker's wristband that is securable about a user's wrist using hook and loop fasteners. The band also includes a cushion having a permanent magnet disposed therein.

U.S. Pat. No. 4,325,504 issued to Amani discloses a magnetic arm or wristband.

U.S. Pat. No. 3,636,568 issued to Stuner discloses a mechanic's glove having a plurality of magnets interspersed within the finger and palm portions thereof.

Although several magnetic gloves and wristbands exist in the prior art, none of the above referenced patents disclose a magnetic tool belt. Furthermore, none of the conventional magnetic gloves or wristbands are designed according to the present invention so as to be usable with and attachable to the magnetic tool belt. As such, the glove, belt clip and wristband according to the present invention each include a fastener thereon for coupling with a mating fastener on the belt.

SUMMARY OF THE INVENTION

The present invention relates to magnetic work apparel. The apparel comprises a hollow glove member formed of a pliable or fabric material having a wrist portion, a lower palm portion, an upper backhand portion, a thumb portion and several finger portions. Integral with the backhand portion is a magnet to which various fasteners may be magnetically secured such as nails, nuts, bolts and screws.

Preferably, the magnet is sandwiched between adjacent layers of fabric or other material used to construct the glove member. Adjacent the wrist portion is one or more snaps for attaching the glove to an accompanying belt. The belt also includes magnets integral therewith for conveniently retaining ferromagnetic items. The apparel further includes accessory devices such as a magnetic wristband and a magnetic belt clip that can be removably fastened to the belt.

It is therefore an object of the present invention to provide work apparel that allows a worker to maintain fasteners within reach.

It is another object of the present invention to provide work apparel that eliminates the need for a worker to wear tool belts and other bulky, cumbersome accessories.

It is yet another object of the present invention to provide work apparel including a magnetic glove, a wristband and a belt clip that can be fastened and stored on a magnetic belt.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
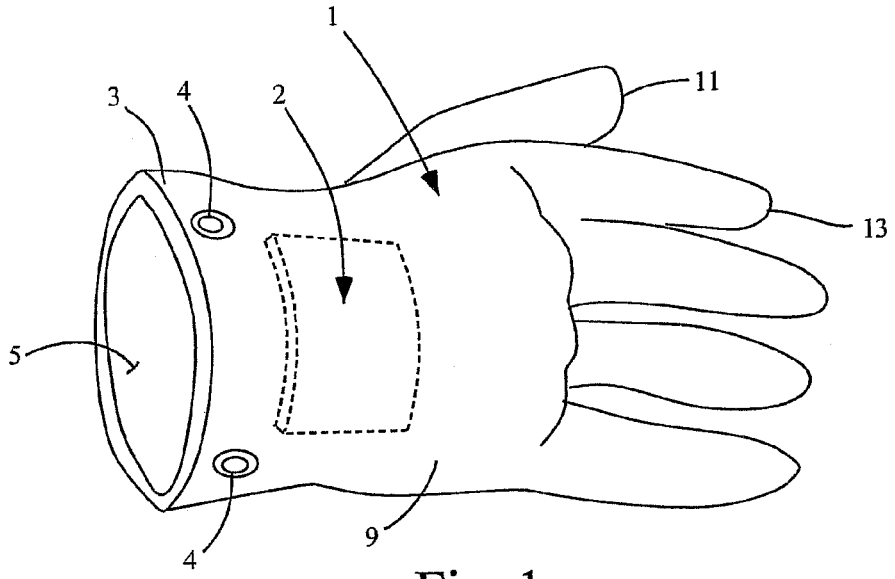
FIG. 1 is a perspective view of the glove member.

Now referring to FIG. 1, the present invention relates to magnetic work apparel. The apparel includes a hollow glove member 1 formed of a pliable or fabric material having a wrist portion 3 defining an opening 5 in communication with a hollow interior. The glove member also includes a lower palm portion, an upper backhand portion 9, a thumb portion 11 and several finger portions 13. Integral with the backhand portion is a magnet 2 to which various fasteners or tools may be secured such as nails, nuts, bolts and screws. Preferably, the magnet is sandwiched between adjacent layers of material used to construct the glove member. Adjacent the wrist portion is one or more snaps 4 for attaching the glove to an accompanying belt as described in more detail, infra.

Figure 2:
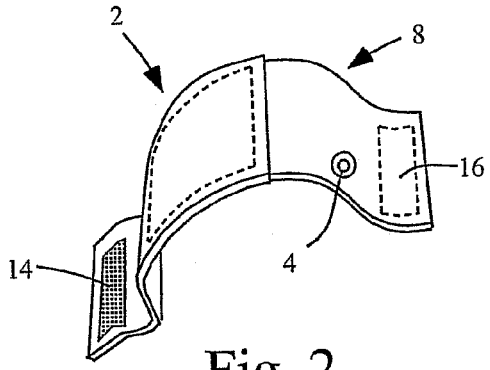
FIG. 2 is a perspective view of the wristband.
Figure 3:
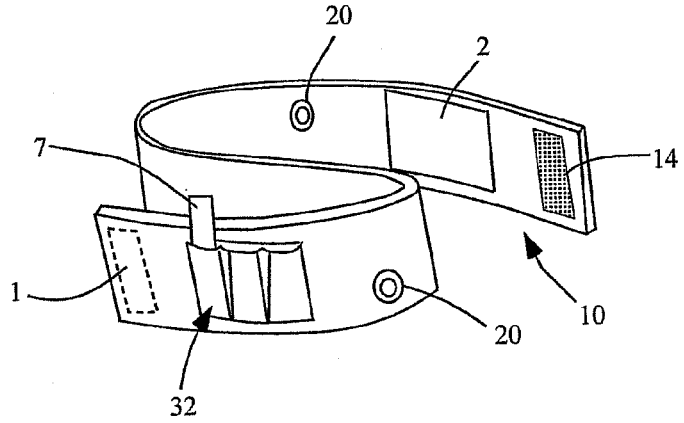
FIG. 3 is a perspective view of the belt.
Figure 4:
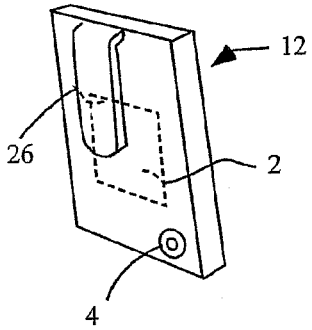
FIG. 4 is a perspective view of the belt clip.

Now referring to FIGS. 2–4, the apparel according to the present invention also includes a magnetic wristband 8, a magnetic belt 10 and a magnetic belt clip 12. The belt and wristband each include two opposing ends with a hook and loop fastener 14 adjacent one end and a mating hook and loop fastener 16 adjacent the opposing end for securing the belt or band about a wearer's waist or wrist, respectively. A magnet 2 is embedded within multiple layers of the belt material. Alternatively, as depicted in FIG. 3, the belt may include pockets 32 with magnets 7 removably received therein. A plurality of snaps 20 are positioned on the belt to which the mating snaps on the glove, the wristband or belt clip can be fastened when such items are not in use.

The belt clip 12 further includes a front surface and a rear surface with a clip 26 positioned on the rear surface for securing the clip to a user's belt or other convenient location. The clip also includes a magnet 2 embedded therein. The accessory items can be used in the same fashion as the work glove to conveniently retain ferromagnetic fasteners and tools within reach.

Preferably, the magnets are flexible allowing the items to be comfortably worn by a user. Though the present invention has been primarily described as being designed to assist a worker in retaining fasteners and drill bits, the device can be used in any application in which it is advantageous to maintain small, ferrous items within reach. For example, the glove can be used by fishermen to retain fish hooks, or by mechanics to retain wheel lugs or other small auto parts, etc. Furthermore, the size, shape and materials of construction of the various components can be varied to suit a particular application.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination, a belt member and a magnetic accessory apparel item comprising:

an elongated belt member having two opposing ends with mating fasteners adjacent each end for securing said belt about a wearer's waist;

at least one magnet embedded within said belt member;

a plurality of fasteners positioned on said belt member;

a magnetic accessory apparel item removably securable to said fasteners.

2. The combination according to claim 1 wherein said accessory item comprises:

a glove having a wrist portion, a hand portion extending from said wrist portion, said hand portion including a backhand portion with a magnet embedded therein;

a fastener means positioned adjacent said wrist portion for mating with said fastener on said belt to secure said glove thereto.

3. The combination according to claim 1 wherein said accessory item includes a belt clip having a magnet embedded therein.

4. The combination according to claim 1 wherein said accessory item includes a wrist band having two opposing ends, each having a mating attachment means adjacent thereto for securing the wristband about a wearer's wrist, said wristband having a magnet embedded therein;

a fastener means positioned on said wristband for mating with said fastener means on said belt.

* * * * *